US005547033A

United States Patent [19]

Campos, Jr.

[11] Patent Number: 5,547,033

[45] Date of Patent: Aug. 20, 1996

[54] ROTARY CONE DRILL BIT AND METHOD FOR ENHANCED LIFTING OF FLUIDS AND CUTTINGS

[75] Inventor: Harry M. Campos, Jr., Grand Prairie, Tex.

[73] Assignee: Dresser Industries, Inc., Dallas, Tex.

[21] Appl. No.: 351,019

[22] Filed: Dec. 7, 1994

[51] Int. Cl.[6] ..... E21B 10/08

[52] U.S. Cl. ..... 175/331; 175/377

[58] Field of Search ..... 175/331, 337, 175/338, 339, 374, 375, 377, 394, 325.5, 65

[56] References Cited

U.S. PATENT DOCUMENTS

Re. 19,339 10/1934 Vertson ..... 175/347

(List continued on next page.)

FOREIGN PATENT DOCUMENTS

| | | | |
|---|---|---|---|
| 936382 | 12/1955 | Germany . | |
| 533719 | 10/1976 | U.S.S.R. | 175/394 |
| 1305295 | 4/1987 | U.S.S.R. | 175/331 |
| 1467157 | 3/1989 | U.S.S.R. | 175/339 |

OTHER PUBLICATIONS

International Search Report, International Application No. PCT/US95/10015, dated Jan. 4, 1996.

U.S. Design Patent Application No. 29/043782, filed Sep. 12, 1995, entitled Rotary Cone Drill Bit.

U.S. Patent Application 08/350910 filed Dec. 7, 1994 and entitled Rotary Cone Bit With Angled Ramps (Attorney Docket No. 060220.0179).

U.S. Patent Application 08/422140 filed Apr. 13, 1995 and entitled Rotary Drill Bit And Method For Manufacture And Rebuild (Attorney Docket No. 060220.0205).

U.S. Patent Application 08/478455 filed Jun. 6, 1995 and entitled Rotary Cone Drill Bit Modular Arm (Attorney Docket No. 060220.0193).

U.S. Patent Application 29/033599 filed Jan. 17, 1995 and entitled Rotary Cone Bit (Attorney Docket No. 060220.0173).

U.S. Patent Application 29/033630 filed Jan. 17, 1995 and entitled Support Arm And Rotary Cone For Modular Drill Bit (Attorney Docket No. 060220.0174).

Security/Dresser "Security Oilfield Catalog" Rock Bits, Diamond Products, Drilling Tools, *Security Means Technology*, Nov. 1991 –Nov. 1992.

"State of the Science in Rock Bit Tech." by Carlos Fernandez, Spacebit, Aug. 8, 1991.

Security/Dresser "Security Oilfield Catalog" Rock Bits, Diamond Products, Drilling Tools, *Security Means Technology*. (undated).

"State of the Science in Rock Bit Techn." by Carlos Fernandez, Spacebit. Aug. 1991.

U.S. Patent Application Serial No. 08/287,457, filed Aug. 8, 1994 and entitled Rock Bit With Enhanced Fluid Return Area.

U.S. Patent Application Serial No. 08/287,446, filed Aug. 8, 1994 and entitled Modular Rotary Drill Bit.

U.S. Patent Application Serial No. 08/287,441, filed Aug. 8, 1994 and entitled Rotary Cone Drill Bit With Improved Support Arms.

U.S. Patent Application Serial No. 08/287,390, filed Aug. 8, 1994 and entitled Rotary Cone Drill Bit And Method For Manufacture And Rebuild.

*Primary Examiner*—David J. Bagnell

*Attorney, Agent, or Firm*—Baker & Botts, L.L.P.

[57] ABSTRACT

A rotary cone drill bit for forming a borehole having a bit body with an upper end portion adapted for connection to a drill string. A number of support arms extend from the bit body. Each support arm has an exterior surface. A number of cutter cone assemblies equal to the number of support arms are mounted respectively on the support arms and project generally downwardly and inwardly with respect to an associated support arm. A ramp is formed on the exterior surface of the support arm and is inclined at an angle from a leading edge of the support arm toward a trailing edge of the support arm such that the ramp directs cuttings upward in the borehole.

29 Claims, 2 Drawing Sheets

U.S. PATENT DOCUMENTS

| | | | |
|---|---|---|---|
| Re. 32,495 | 9/1987 | Coates | 175/339 |
| D. 265,205 | 6/1982 | Munson | D15/139 |
| 1,906,427 | 5/1933 | Sievers et al. | 175/292 |
| 1,908,049 | 5/1933 | Reed | 175/313 |
| 2,030,723 | 2/1936 | Scott et al. | 175/362 |
| 2,047,112 | 7/1936 | Reed | 175/363 |
| 2,063,012 | 12/1936 | Catland | 175/357 |
| 2,064,273 | 12/1936 | Scott | 175/342 |
| 2,065,743 | 12/1936 | Reed | 175/366 |
| 2,068,375 | 1/1937 | Catland | 175/357 |
| 2,124,521 | 7/1938 | Williams et al. | 175/366 |
| 2,151,347 | 3/1939 | Fisher | 175/363 |
| 2,176,358 | 10/1939 | Pearce | 175/354 |
| 2,260,487 | 10/1941 | Scott | 175/340 |
| 2,318,370 | 5/1943 | Burch | 175/366 |
| 2,648,526 | 8/1953 | Lanchester | 175/340 |
| 2,782,005 | 2/1957 | Appleton | 175/339 |
| 2,950,090 | 8/1960 | Swart | 175/340 |
| 3,130,801 | 4/1964 | Schumacher, Jr. | 175/374 |
| 3,442,342 | 5/1969 | McElya et al. | 175/374 |
| 3,628,616 | 12/1971 | Neilson | 175/375 |
| 3,800,891 | 4/1974 | White et al. | 175/374 |
| 3,825,083 | 7/1974 | Flarity et al. | 175/394 |
| 3,850,256 | 11/1974 | Mcqueen | 175/228 |
| 4,054,772 | 10/1977 | Lichte | 219/121.14 |
| 4,056,153 | 11/1977 | Miglierini | 175/376 |
| 4,067,406 | 1/1978 | Garner et al. | 175/341 |
| 4,098,448 | 7/1978 | Sciaky et al. | 228/102 |
| 4,145,094 | 3/1979 | Verzirian | 384/96 |
| 4,209,124 | 6/1980 | Baur et al. | 228/182 |
| 4,256,194 | 3/1981 | Varel | 175/375 |
| 4,280,571 | 7/1981 | Fuller | 175/337 |
| 4,333,364 | 6/1982 | Varel | 76/108.2 |
| 4,350,060 | 9/1982 | Vezirian | 76/108.2 |
| 4,352,400 | 10/1982 | Grappendorf et al. | 175/405.1 |
| 4,369,849 | 1/1983 | Parrish | 175/340 |
| 4,417,629 | 11/1983 | Wallace | 175/356 |
| 4,421,184 | 12/1983 | Mullins | 175/337 |
| 4,552,232 | 11/1985 | Frear | 175/337 |
| 4,623,027 | 11/1986 | Vezirian | 175/340 |
| 4,624,329 | 11/1986 | Evans et al. | 175/374 |
| 4,630,693 | 12/1986 | Goodfellow | 175/366 |
| 4,635,728 | 1/1987 | Harrington | 166/341 |
| 4,711,143 | 12/1987 | Loukanis et al. | 76/108.2 |
| 4,727,943 | 3/1988 | Wood | 175/229 |
| 4,750,573 | 6/1988 | Wynn | 175/359 |
| 4,765,205 | 8/1988 | Higdon | 76/108.2 |
| 4,813,502 | 3/1989 | Dysart | 175/337 |
| 4,817,852 | 4/1989 | Hill | 228/114 |
| 4,848,491 | 7/1989 | Burridge et al. | 175/393 |
| 4,986,375 | 1/1991 | Maher | 175/323 |
| 5,040,623 | 8/1991 | Vezirian | 175/354 |
| 5,074,367 | 12/1991 | Estes | 175/374 |
| 5,131,478 | 7/1992 | Brett et al. | 175/57 |
| 5,145,016 | 9/1992 | Estes | 175/331 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,224,560 | 7/1993 | Fernandez | 175/374 |
| 5,281,260 | 1/1994 | Kumar et al. | 75/240 |
| 5,289,889 | 3/1994 | Gearhart et al. | 175/325.5 |
| 5,351,768 | 10/1994 | Scott et al. | 175/374 |
| 5,439,067 | 8/1995 | Huffstutler | 175/339 |
| 5,439,068 | 8/1995 | Huffstutler et al. | 175/356 |

ROTARY CONE DRILL BIT AND METHOD FOR ENHANCED LIFTING OF FLUIDS AND CUTTINGS

RELATED APPLICATIONS

This application is related to copending patent application entitled ROTARY CONE DRILL BIT WITH ANGLED RAMPS, Ser. No. 08/350,910, filed Dec. 7, 1994, (Attorney Docket No. 60220-0179); design patent application entitled ROTARY CONE DRILL BIT now abandoned, Ser. No. 29,033,599, filed Jan. 17, 1995, (Attorney Docket No. 60220-0173); copending design patent application entitled SUPPORT ARM AND ROTARY CONE FOR MODULAR DRILL BIT, Ser. No. 29,033,630, filed Jan. 17, 1995 (Attorney Docket No. 60220-0174).

TECHNICAL FIELD OF THE INVENTION

This invention relates in general to the field of rotary drill bits used in drilling a borehole in the earth and in particular to a rotary cone drill bit and method for enhanced lifting of fluids and cuttings.

BACKGROUND OF THE INVENTION

Various types of rotary drill bits or rock bits may be used to form a borehole in the earth. Examples of such rock bits include roller cone bits or rotary cone bits used in drilling oil and gas wells. A typical roller cone bit comprises a bit body with an upper end adapted for connection to a drill string. A plurality of support arms, typically three, depend from the lower end portion of the bit body with each arm having a spindle protruding radially inward and downward with respect to a projected rotational axis of the bit body.

Conventional roller cone bits are typically constructed in three segments. The segments may be positioned together longitudinally with a welding groove between each segment. The segments may then be welded with each other using conventional techniques to form the bit body. Each segment also includes an associated support arm extending from the bit body. An enlarged cavity or passageway is typically formed in the bit body to receive drilling fluids from the drill string. U.S. Pat. No. 4,054,772 entitled, *Positioning System for Rock Bit Welding* shows a method and apparatus for constructing a three cone rotary rock bit from three individual segments. U.S. Pat. No. 4,054,772 is incorporated by reference for all purposes within this application.

A cutter cone is generally mounted on each spindle and supported rotatably on bearings acting between the spindle and the inside of a spindle receiving cavity in the cutter cone. One or more nozzles may be formed on the underside of the bit body adjacent to the support arms. The nozzles are typically positioned to direct drilling fluid passing downwardly from the drill string through the bit body toward the bottom of the borehole being formed. Drilling fluid is generally provided by the drill string to perform several functions including washing away material removed from the bottom of the borehole, cleaning the cutter cones, and carrying the cuttings radially outward and then upward within the annulus defined between the exterior of the bit body and the wall of the borehole. U.S. Pat. No. 4,056,153 entitled, *Rotary Rock Bit with Multiple Row Coverage for Very Hard Formations* and U.S. Pat. No. 4,280,571 entitled, *Rock Bit* show examples of conventional roller cone bits with cutter cone assemblies mounted on a spindle projecting from a support arm. U.S. Pat. No. 4,056,153 and U.S. Pat. No. 4,280,571 are incorporated by reference for all purposes within this application.

While drilling with such rotary or rock bits, fluid flow in the vicinity of the cutter cones may be very turbulent, thereby inhibiting an even, upward flow of cuttings and other debris from the bottom of the borehole through the annulus to the well surface. Furthermore, such debris may collect in downhole locations with restricted fluid flow. Examples of such locations with restricted fluid flow include the lower portion of the bit body adjacent to the respective support arms and the annulus area between the exterior of the bit body and the adjacent wall of the borehole. Other areas of restricted fluid flow may include the backface of the respective cutter cones and the wall of the borehole. As a result of collecting such debris, the area available for fluid flow is reduced even further resulting in an increase in fluid velocity through such areas and erosion of the adjacent metal components. As this erosion progresses, vital components such as bearings and seals may be exposed to drilling fluids and well debris which can lead to premature failure of the associated rock bit.

SUMMARY OF THE INVENTION

In accordance with the present invention, the disadvantages and problems associated with previous rock bits and rotary cone drill bits have been substantially reduced or eliminated. In one embodiment, the present invention includes a support arm and cutter cone assembly which provide enhanced fluid flow around the exterior of an associated rotary drill bit during drilling operations for removal of cuttings and other debris from the bottom of the borehole to the well surface. A ramp is provided on an exterior surface of each support arm. The ramp is formed at an angle such that the ramp slopes upward from the leading edge of the support arm to the trailing edge. The ramp aids the flow of fluid, cuttings, and other debris to the annulus formed between the wall of the borehole and the exterior of an associated drill string.

A technical advantage of the present invention includes that the ramp divides turbulent fluid flow around the rotating cutter cones from fluid flow in the annulus above the cutter cones such that cuttings and other debris entering the annulus are not drawn back down toward the cutter cones. The outer diameter of the ramp is substantially equal to the diameter of the borehole. Thereby, the ramp, in cooperation with other components of the bit body, separates fluid at the drill bit into two substantially independent regions. Fluid flow below the ramp is turbulent and multidirectional due to the fluid exiting the nozzles and the churning effect of the cutter cones. Fluid flow above the ramp is relatively less turbulent and unidirectional upwardly through the annulus because the trailing edge of the ramp is preferably located above the exit end of the nozzles and the cutter cones. Thus, fluid flow in this region is not subject to the churning action of the cutter cones or downward flow from the nozzles.

Another technical advantage of the present invention includes that the ramp provides a means for lifting cuttings and other debris upward to the annulus and away from the cutter cones. As the drill bit rotates, fluid and debris move upward along the ramp toward the annulus. This reduces the effect of cuttings interfering with the area available for fluid flow.

Another technical advantage of the present invention includes that use of a ramp on the support arm provides a gap between the support arm above the ramp and the wall of the borehole thereby increasing the upward flow of fluid and debris. Furthermore, a second gap is also provided below the ramp which may also increase fluid flow. This second gap allows for increased mixing of drilling fluid and cuttings to be lifted up by a ramp disposed on an adjacent support arm.

BRIEF DESCRIPTION OF THE DRAWINGS

For a more complete understanding of the present invention, and the advantages thereof, reference is now made to the following description taken in conjunction with the accompanying drawings in which like reference numbers indicate like features and wherein.

DETAILED DESCRIPTION OF THE INVENTION

The present invention and its advantages are best understood by referring to FIGS. 1 through 4 of the drawings, like numerals being used for like and corresponding parts of the drawings.

Figure 2:
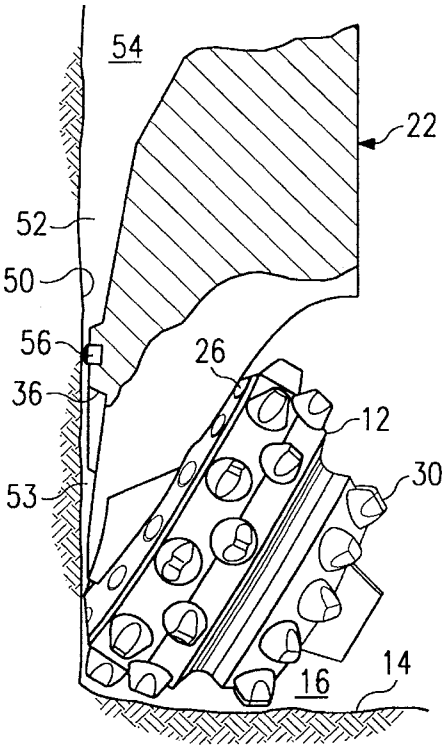
FIG. 2 is a schematic drawing in elevation and section with portions broken away showing a support arm of a rotary cone drill bit incorporating features of the present invention and disposed in a well bore.
Figure 1:
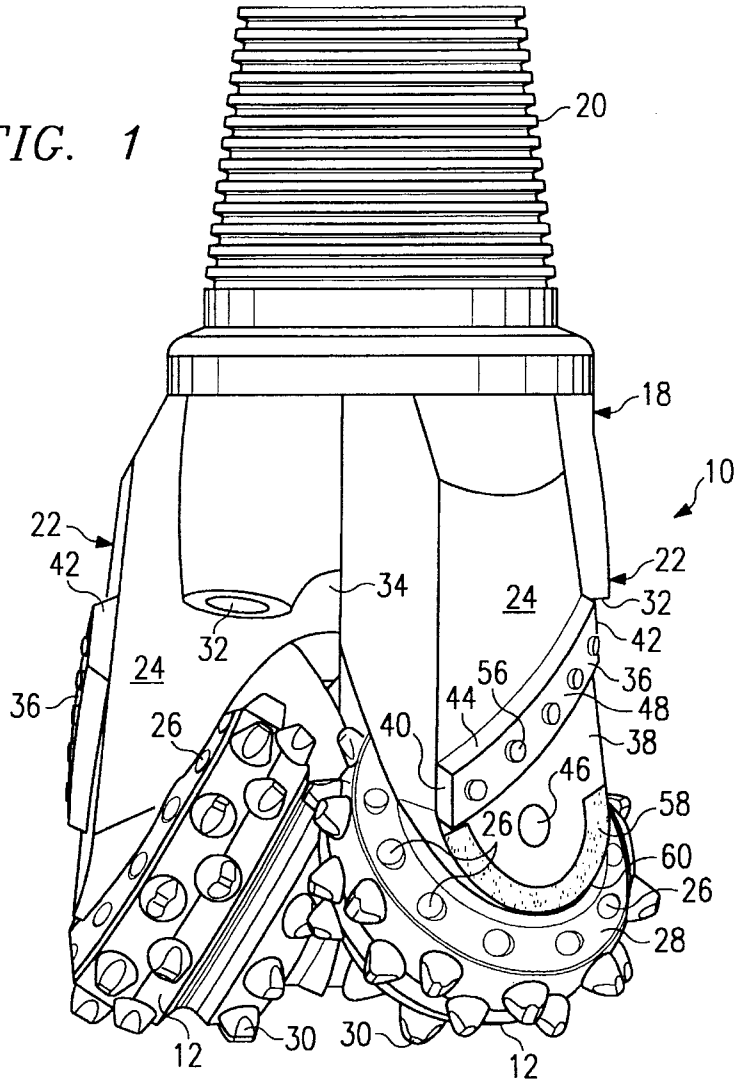
FIG. 1 is an isometric view of a rotary cone drill bit constructed according to the teachings of the present invention.

FIG. 1 illustrates a roller cone rock bit, indicated generally at 10, constructed according to the teachings of one aspect of the present invention. As shown in FIG. 2, roller cone rock bit 10 may be used to drill a borehole by the cutting action of cutter cones 12 as roller cone rock bit 10 is rolled around bottom 14 of borehole 16 by the rotation of a drill string (not shown) attached to roller cone rock bit 10.

Roller cone rock bit 10 comprises a bit body 18 having a tapered, externally threaded upper section 20 adapted to be secured to the lower end of the drill string (not shown). Three cutter assemblies (two visible in FIG. 1) indicated generally at 22, depend from bit body 18 (not shown). Cutter cone assemblies 22 and bit body 18 may comprise an integrated unit. Alternatively, cutter cone assemblies 22 may be modular units that are removably attached to bit body 18 (not shown). Each cutter assembly 22 preferably comprises a support arm 24 and a cutter cone 12.

Each cutter cone 12 may include, for example, a number of surface compacts 26 disposed in a gauge face surface 28 of each cutter cone 12. Each cutter cone 12 may also include a number of teeth 30. Surface compacts 26 and teeth 30 may comprise compacts or inserts that are formed from various hard materials as desired. Alternatively, teeth 30 may be milled from cutter cone 12 itself.

During drilling, borehole debris is removed from bottom 14 of borehole 16. A number of nozzles 32 extend from an underside 34 of roller cone rock bit 10 and supply drilling fluid to aid in the removal of the debris. The drilling fluid flows radially outward between the underside 34 and bottom 14 of borehole 16. A number of ramps 36 located on support arms 24 also aid in the removal process.

Ramp 36 is disposed on exterior surface 38 of support arm 24. Ramp 36 may be formed out of each support arm 24 by a machining operation. Alternatively, ramp 36 may be formed on exterior surface 38 of support arm 24 by first depositing weld material on surface 38. The weld material may then be machined to a desired shape for ramp 36. Finally, ramp 36 may be formed on support arm 24 during the process of forging support arm 24. After support arm 24 has been forged, ramp 38 may be further machined to define its desired structure.

Ramp 36 comprises leading edge 40, trailing edge 42 and top surface 44. Top surface 44 of ramp 36 slopes generally upward along surface 38 of support arm 24 from leading edge 40 to trailing edge 42. At trailing edge 42, top surface 44 is preferably located at or above the exit of nozzle 32. In modular roller cone rock bits, top surface 44 may be disposed below nozzle 32 if the exit of nozzle 32 is disposed closer to the center of bit body 18. It is desirable to have top surface 44 at leading edge 40 be as low as possible on support arm 24 so as to aid in removal of cuttings and other debris. For some applications, top surface 44 at leading edge 40 of ramp 36 may be located at approximately the same level as ball plug hole 46.

Ramp 36 also has a thickness defined by top surface 44. The thickness of ramp 36 may be chosen such that an outer surface 48 of ramp 36 is located a predetermined distance from a wall 50 of borehole 16 when roller cone rock bit 10 is disposed in borehole 16. The use of ramp 36 allows formation of a first gap 52 between surface 38 of support arm 24 and wall 50 of borehole 16. First gap 52 allows increased fluid flow up into an annulus 54 formed between wall 50 of borehole 16 and the exterior of an associated drill string. A second gap 53 is also formed between surface 38 of support arm 24 and wall 50 of borehole 16 below ramp 36. Second gap 53 allows increased mixing of cuttings and other debris with the drilling fluid for removal from borehole 16.

Figure 4:
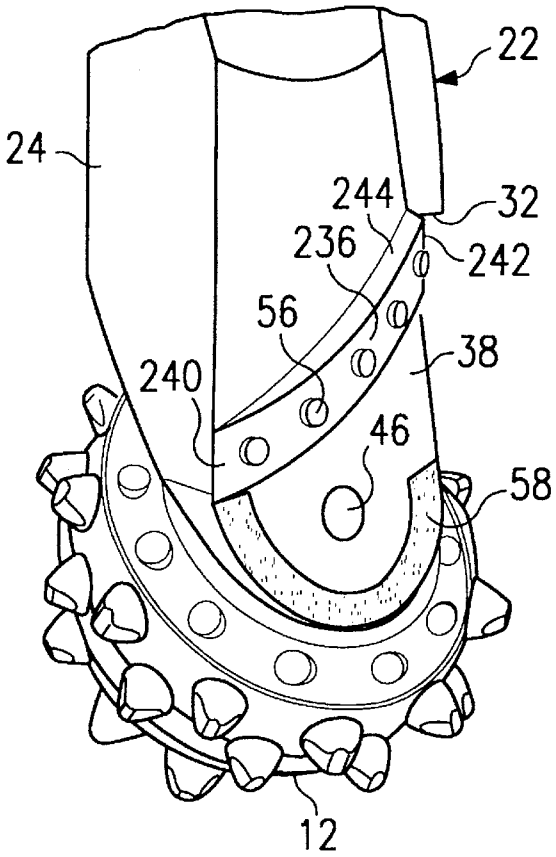
FIG. 4 is an isometric view of another embodiment of a support arm for a rotary cone drill bit having a ramp constructed according to the teachings of the present invention.
Figure 3:
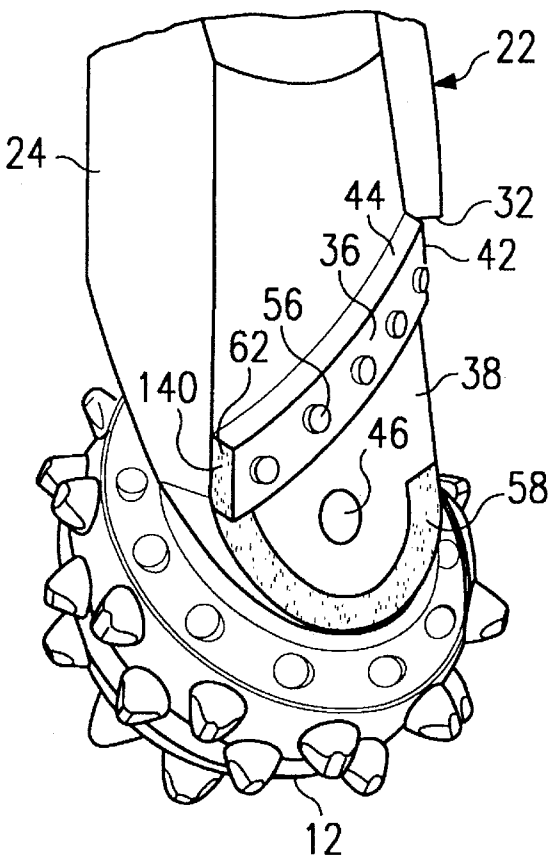
FIG. 3 is an isometric view of another embodiment of a support arm for a rotary cone drill bit having a ramp constructed according to the teachings of the present invention.

The structure of ramp 36 may be protected by several different means. First, ramp 36 may comprise a plurality of inserts 56. Additionally, hardfacing 58 may be applied to shirttail 60 of support arm 24. As shown in FIG. 3, hardfacing 62 may also be applied to leading edge 140 of ramp 36. Hardfacing 62 may comprise chips or particles of tungsten carbide or other appropriate material for preventing wear on ramp 36. As shown in. FIG. 4, leading edge 240 of ramp 236 may be chamfered such that the thickness of ramp 36 may increase from leading edge 240 to trailing edge 242. The chamfered leading edge 240 reduces the possibility of extra torque on rotary cone drill bit 10 while rotating in borehole 16.

As shown in FIG. 2, roller cone rock bit 10 operates to scrape and gauge the sides and bottom 14 of borehole 16 utilizing surface compacts 26 and teeth 30 under downhole force supplied through the drill string. Roller cone rock bit 10 rotates to the right in borehole 16. Cutter cones 12 create cuttings and other debris at the bottom 14 of borehole 16. Drilling fluid is ejected from nozzles 32 toward cutter cones 12. As roller cone rock bit 10 rotates, the leading edge 40 of ramp 36 picks up cuttings and fluid. The fluid and cuttings move up along surface 44 toward the trailing edge 42 of ramp 36 and thus flow upward into annulus 54 toward the surface of the borehole.

A technical advantage of the present invention is that ramp 36 divides turbulent fluid flow around rotating cutter cones 12 and less turbulent, upward fluid flow in annulus 54 such that cuttings and other debris entering annulus 54 are not drawn back down toward cutter cones 12. Additionally, top surface 44 of ramp 36 lifts cuttings and other debris up toward annulus 54 and away from cutter cones 12. This reduces the effect of cuttings interfering with the area available for fluid flow around cutter cones 12.

Although the present invention and its advantages have been described in detail, it should be understood that various changes, substitutions and alterations can be made therein without departing from the spirit and scope of the invention as defined by the appended claims.

What is claimed is:

1. A rotary cone drill bit for forming a borehole, comprising:

a bit body having an upper end portion adapted for connection to a drill string for rotation of said bit body;

a number of support arms extending from said bit body, each of said support arms having a leading edge and a trailing edge;

a number of cutter cone assemblies equaling said number of support arms and rotatably mounted respectively on one of said support arms and projecting generally downwardly and inwardly with respect to its associated support arm; and a surface formed on the exterior of each support arm, each of said surfaces inclined at an angle from said leading edge toward said trailing edge such that said surfaces cooperate with each other to direct cuttings and fluid upwardly in the borehole.

2. The drill bit of claim 1, and further comprising:

said surface having one end adjacent to said trailing edge and another end adjacent to said leading edge; and a nozzle having an exit disposed adjacent to at least one of said support arms, wherein said end of said surface at said trailing edge is positioned above said exit from said nozzle.

3. The drill bit of claim 1, wherein said surface is formed on a ramp as an integral part of said support arm.

4. The drill bit of claim 1, wherein said surface comprises a weld material deposited on said exterior of said support arm to form a ramp extending from said leading edge to said trailing edge.

5. The drill bit of claim 1, wherein said surface is formed on said exterior of said support arm during the forging process for forming said support arm.

6. The drill bit of claim 1, wherein said support arms further comprise hardfacing formed along a leading edge of said respective surfaces.

7. The drill bit of claim 1, further comprising a plurality of inserts disposed in said exterior of said support arm adjacent to said surfaces.

8. The drill bit of claim 1, wherein an outer diameter of said surface is approximately equal to a maximum outer diameter of the drill bit such that as the drill bit is rotated in a borehole, said surface lifts drilling fluids and cuttings upwards and away from a bottom of the borehole.

9. The drill bit of claim 1, wherein a leading edge of said surface is chamfered such that the thickness of the surface increases from said leading edge of said surface to said trailing edge of said support arm.

10. The drill bit of claim 1, wherein said cutter cone assemblies each comprise a cutter cone having a plurality of teeth milled out of said cutter cone.

11. A support arm and cutter assembly for a rotary drill bit having a bit body, comprising:

said support arm extending from said bit body and having an exterior surface;

said cutter cone assembly mounted on said support arm and projecting generally downwardly and inwardly with respect to said support arm; and a ramp formed on said exterior surface of said support arm, said ramp inclined at an angle from a leading edge of said support arm toward a trailing edge of said support arm such that said ramp directs cuttings upwardly in a borehole.

12. The support arm of claim 11, and further comprising a nozzle disposed adjacent to each support arm, wherein a top surface of said ramp at said trailing edge is positioned above an exit of said nozzle.

13. The support arm of claim 11, wherein said ramp is formed integral with said support arm.

14. The support arm of claim 11, wherein said ramp comprises a weld material deposited on said exterior surface of said support arm to form said ramp.

15. The support arm of claim 11, wherein said ramp is formed on an exterior surface of said support arm during the forging process for forming said support arm.

16. The support arm of claim 11, wherein said ramp further comprises hardfacing formed along a leading edge of said ramp.

17. The support arm of claim 11, wherein said ramp further comprises a plurality of inserts disposed in an outer surface of said ramp.

18. The support arm of claim 11, wherein an outer diameter of said ramp is approximately equal to a maximum outer diameter of the drill bit such that as the drill bit is rotated in a borehole, said ramp forces the flow of cuttings along said ramp upwards and away from a bottom of the borehole.

19. The support arm of claim 11, wherein a leading edge of said ramp is chamfered such that the thickness of the ramp increases from said leading edge of said ramp to said trailing edge of said support arm.

20. The support arm of claim 11, wherein said cutter cone assemblies each comprise a cutter cone having a plurality of teeth milled out of said cutter cone.

21. A support arm and cutter assembly for a rotary drill bit having a bit body, comprising:

said support arm extending from said bit body and having an exterior surface;

said cutter cone assembly mounted on said support arm and projecting generally downwardly and inwardly with respect to said support arm;

a ramp formed on said exterior of said support arm, said ramp having a surface inclined at an angle from a leading edge of said support arm toward a trailing edge of said support arm such that said ramp directs cuttings upwardly in the borehole;

a plurality of inserts disposed in said ramp; and a hardfacing material disposed on a leading edge of said ramp and a shirttail of said support arm.

22. The support arm of claim 21, wherein said ramp is integral with said support arm.

23. A method for enhanced lifting of fluids and cuttings from a borehole, comprising the steps of:

providing a rotary cone drill bit having a plurality of support arms extending from a bit body, a cutter cone projecting generally downwardly and inwardly with respect to each support arm;

forming a surface on an exterior of each support arm, each of said surfaces inclined at an angle from a leading edge to a trailing edge of its respective support arm;

inserting the rotary cone rock bit into a borehole;

directing drilling fluid from the rotary cone rock bit toward a bottom of the borehole; and rotating the rotary cone rock bit within the borehole such that the cutter cones rotate on the support arms so as to form cuttings and the inclined surfaces on the support arms cooperate with each other to direct the cuttings and fluid upwardly in the borehole.

24. The method of claim 23, wherein said step of directing drilling fluid comprises the step of ejecting drilling fluid from a plurality of nozzles disposed adjacent to each support arm.

25. The method of claim 23, wherein said step of providing a rotary cone rock bit comprises the step of providing a rotary cone rock bit wherein the inclined surface is formed on a ramp as an integral part of the respective support arm.

26. The method of claim 23, further comprising the step of depositing a weld material on the exterior of each support arm to form a ramp extending from the leading edge to the trailing edge of the support arm with the inclined surface deposed thereon.

27. The method of claim 23, wherein the step of providing a rotary cone rock bit comprises the step of forming on an exterior of the support arm during forging of the associated support arm.

28. The method of claim 23, wherein said step of providing a rotary cone rock bit comprises the step of providing a hardfacing formed along a leading edge of the inclined surfaces.

29. The method of claim 23, wherein said step of forming a surface on an exterior of each support arm comprises the step of chamfering a leading edge of each inclined surface such that the thickness of each inclined surface increases from the leading edge of said inclined surface to the trailing edge of the respective support arm.

* * * * *